US007261921B1

(12) United States Patent
Hillhouse-Aubry

(10) Patent No.: US 7,261,921 B1
(45) Date of Patent: Aug. 28, 2007

(54) METHOD OF PRODUCING AN ENHANCED PAINTED APPEARANCE

(75) Inventor: Theresalee Hillhouse-Aubry, Hurst, TX (US)

(73) Assignee: Terry Hillhouse Designs, Inc., Hurst, TX (US)

( * ) Notice: Subject to any disclaimer, the term of this patent is extended or adjusted under 35 U.S.C. 154(b) by 0 days.

(21) Appl. No.: 11/492,322

(22) Filed: Jul. 25, 2006

Related U.S. Application Data

(60) Provisional application No. 60/702,266, filed on Jul. 25, 2005.

(51) Int. Cl.
*B05D 1/00* (2006.01)
*B05D 3/02* (2006.01)
*B05D 3/10* (2006.01)

(52) U.S. Cl. ..... 427/273; 427/288; 427/389.9; 427/393.2

(58) Field of Classification Search ..... None
See application file for complete search history.

(56) References Cited

U.S. PATENT DOCUMENTS

2002/0138920 A1* 10/2002 Pepitone ..... 8/445

* cited by examiner

*Primary Examiner*—William Phillip Fletcher, III
(74) *Attorney, Agent, or Firm*—Bracewell & Giuliani LLP

(57) ABSTRACT

A method of creating an image with an antique appearance includes the step of providing an image formed with an image-forming component on a fibrous material. The image is then antiqued by dissolving the image-forming component with a first chemical solution. The image-forming component is set with a second chemical solution that stops the antiquing of the image with the first chemical solution. The image-forming component can be food coloring, or ink. The first chemical solution can be made of a glue component, an alcohol component, an oil component, a casein component, and yeast. The second chemical solution can include an acrylic polymer selected from a group consisting of polyurethane, clear wax, floor wax, bees wax, and a polymer elusion.

20 Claims, 1 Drawing Sheet

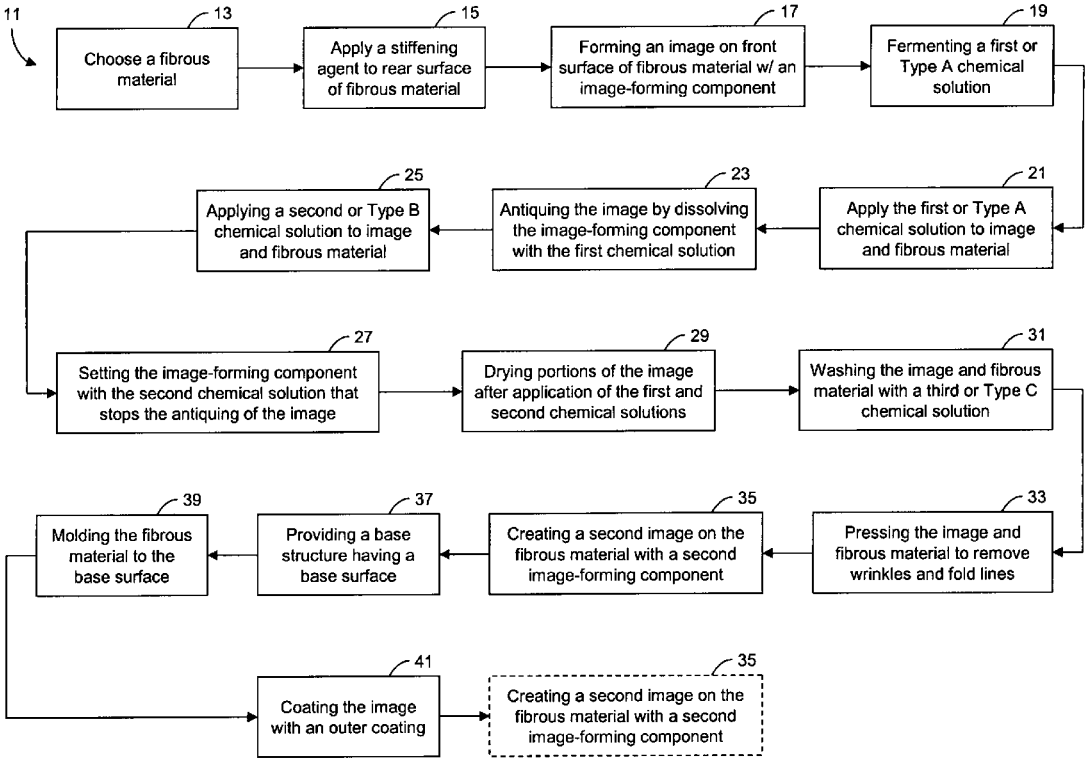

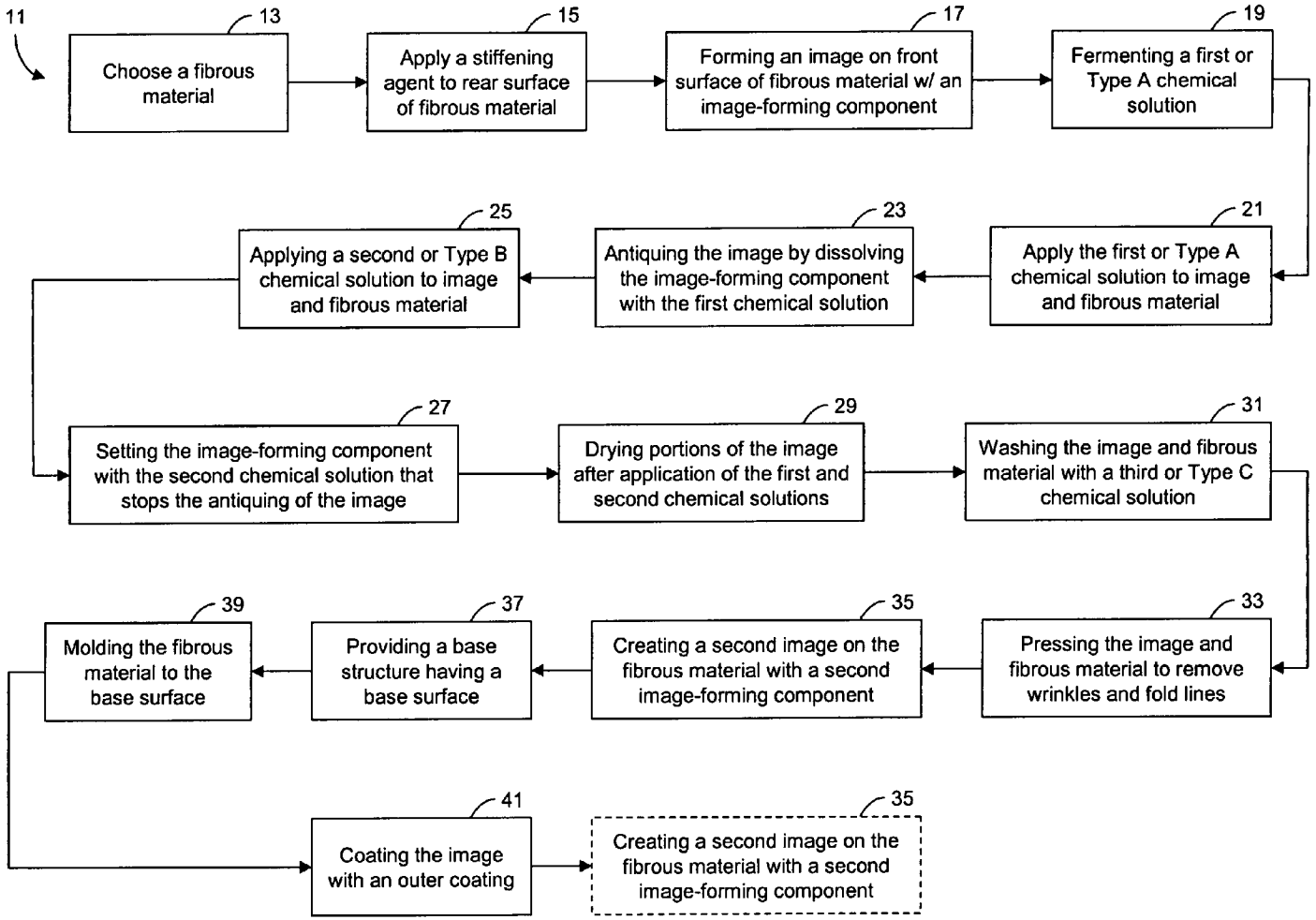
11
13
Choose a fibrous material
15
Apply a stiffening agent to rear surface of fibrous material
17
Forming an image on front surface of fibrous material w/ an image-forming component
19
Fermenting a first or Type A chemical solution
21
Apply the first or Type A chemical solution to image and fibrous material
23
Antiquing the image by dissolving the image-forming component with the first chemical solution
25
Applying a second or Type B chemical solution to image and fibrous material
27
Setting the image-forming component with the second chemical solution that stops the antiquing of the image
29
Drying portions of the image after application of the first and second chemical solutions
31
Washing the image and fibrous material with a third or Type C chemical solution
33
Pressing the image and fibrous material to remove wrinkles and fold lines
35
Creating a second image on the fibrous material with a second image-forming component
37
Providing a base structure having a base surface
39
Molding the fibrous material to the base surface
41
Coating the image with an outer coating
35
Creating a second image on the fibrous material with a second image-forming component

METHOD OF PRODUCING AN ENHANCED PAINTED APPEARANCE

RELATED APPLICATIONS

This nonprovisional application claims the benefit of co-pending, provisional patent application U.S. Ser. No. 60/702,266, filed on Jul. 25, 2005, which is hereby incorporated by reference in its entirety.

BACKGROUND OF THE INVENTION

1. Field of the Invention

This invention relates generally to printing, and relates more particularly to a method of producing an enhanced painted appearance on a fibrous material.

2. Background of the Invention

Many types of printing are available for various advertising and promotional purposes, whether printing a printed indicia on canvas, paper, cloth, or other substances. An attractive and visually stimulating printing on a promotion or advertisement can often be essential in developing awareness for the subject matter that is being advertised or promoted.

For example, screen printing is a printing technique involving the passage of printing medium, such as ink, through a web or fabric, which has been stretched on a frame, to which a refined form of stencil has been applied. The stencil openings determine the form and dimensions of the imprint thus produced.

Also, for example, lithographic printing is a process in which the printing and non-printing surfaces are on the same plane and the substrate makes contact with the whole surface. The printing part of the surface is treated to receive and transmit ink to the paper, usually via a blanket, and the non-printing surface is treated to attract water and thus rejects ink from the ink roller, which touches the surface.

Also, for example, chromographic printing is a process in which a polished section is placed in contact with photographic paper, a current is passed, and ions migrating to the paper are developed so as to produce a color print suitable for microscrutiny. Chromographic printing resembles sulfur printing.

SUMMARY OF THE INVENTION

A method of creating an image with an antique appearance includes the step of (a) providing an image formed with an image-forming component on a fibrous material. The method also includes the step of (b) antiquing the image by dissolving the image-forming component with a first chemical solution. The method also includes the step of (c) setting the image-forming component with a second chemical solution that stops the antiquing of the image with the first chemical solution.

The first chemical solution can be made of a glue component, an alcohol component, an oil component, a pectin component, a casein component, and yeast. The image-forming component can be food coloring, or ink. The ink can be a solventless ink. The method can also include the steps: (d) drying portions of the image after application of the first and second chemical solutions; and (e) heating the image and fibrous material in order to dry portions of the image after application of the first and second chemical solutions.

The method could also include the steps: (d) washing the image and fibrous material with a third chemical solution that comprises water and soap; and (e) pressing the fibrous material with the image so that the image is free of wrinkles and fold lines. The washing of the image and fibrous material can be done with a third chemical solution.

The method can include the additional steps: (d) heating the image and fibrous material in order to dry portions of the image after application of the first and second chemical solutions; (e) washing the image and fibrous material with a third chemical solution that comprises water and soap; (f) pressing the fibrous material with the image so that the image is free of wrinkles and fold lines; and then (g) creating an additional image on the fibrous material with a second image-forming component.

Alternatively, a method of creating an image with an antique appearance includes the step of (a) providing a fibrous material and a first chemical solution comprising yeast. The method also includes the step of (b) placing an ink-based image on a surface of the fibrous material. The method includes the step of (c) fermenting the first chemical solution. The method also includes the step of (d) applying the fermented first chemical solution to the image and fibrous material to antique the image by dissolving the ink. Then, the method includes the step of (e) setting the ink with a second chemical solution that stops the dissolving of the ink with the fermented first chemical solution.

The first chemical solution can include a glue component, an alcohol component, an oil component, a pectin component, a casein component, and yeast. The second chemical solution can include an acrylic polymer selected from a group consisting of polyurethane, clear wax, floor wax, bees wax, and a polymer elusion.

The second chemical solution comprises an acrylic polymer and a stain. The acrylic polymer can be selected from a group consisting of polyurethane, clear wax, floor wax, bees wax, and a polymer elusion. The stain can be selected from a group consisting of a varnish stain, a faux glazing, an oil paint, and a dye. The first chemical solution can comprise by volume: about 5-12% of an oil component; about 75-80% of a glue component; about 4-11% of an alcohol component such that the percentage of the alcohol component is about 1% less then the percentage of the oil component; about 2-6% of a casein component; and the remaining percent comprising a yeast component, a cologne component, a vanilla component, a vinegar component, a pectin component, and a salt component. The first chemical solution can also comprise by volume: about 5-10% of an oil component; about 65-70% of a glue component; about 5% of an alcohol component; about 2-10% of a casein component; about ½-3% of a yeast component; about 5% of a cologne component; about 5% of an imitation vanilla component; about 5-10% of a white vinegar component; about 3-5% of a pectin component; and about ¼-½% of a salt component.

The method can also include the steps of: (f) heating the image and fibrous material at a temperature greater than 250 degrees Fahrenheit in order to dry portions of the image after application of the fermented first chemical solution and the second chemical solution; (g) applying a third chemical solution to the image and fibrous material in order to wash the image and fibrous material; and (h) pressing the fibrous material with the image so that the image is free of wrinkles and fold lines. In step (f) the image and fibrous material can be heated at a temperature between about 265 and 285 degrees Fahrenheit for at least one minute. In step (f) the image and fibrous material can be heated at a temperature about 275 degrees Fahrenheit for at least ten minutes.

A method of creating an image having an antique appearance on a surface of base structure includes the step of providing an image formed with an image-forming component on a fibrous material, and base structure having a base surface. The image is then antiqued by dissolving the image-forming component with a first chemical solution. The image-forming component is then set with a second chemical solution that stops the antiquing of the image with the first chemical solution. The fibrous material is then molded to the base surface. The method can also include the step of coating the image with an outer coating selected from a group consisting of varnish, paint, resin, and silicone.

BRIEF DESCRIPTION OF THE DRAWINGS

FIG. 1 is a schematic block diagram of a system and method of antiquing according to an embodiment of the present invention.

DETAILED DESCRIPTION OF THE PREFERRED EMBODIMENT

Although the following detailed description contains many specific details for purposes of illustration, anyone of ordinary skill in the art will appreciate that many variations and alterations to the following details are within the scope of the invention. Accordingly, the exemplary embodiment of the invention described below is set forth without any loss of generality to, and without imposing limitations thereon, the claimed invention.

In the process of the present invention 11, the user first selects a natural or manmade fiber on which to print the printed indicia 13. In the preferred embodiment, a muslin cloth veneer is used. Muslin is a type of finely-woven cotton fabric, and is typically a closely woven unbleached or white cloth, produced from corded cotton yarn. Muslin can be made of varying degrees of cotton, for example 50% cotton and 50% polyester, which makes a lightweight, durable, and economical backdrop for the printed indicia. Muslin typically refers to a firm cloth for everyday use. Also, the muslin could be a combination of cotton and cellulose, a manmade material cloth fiber that can be printed with low cost ink jet dye or food color and which is environmentally friendly. Cellulose can be processed with a casein solution or with a non-casein solution to convert printed fabric for application of veneer for any type of surface. Muslin cloth can be painted to look like countless different settings and if it is treated properly it can become translucent. With the right lighting changes, a backdrop painted on muslin can provide a very bright appearance or a very dim appearance, allowing a set to be transformed almost instantaneously from one setting to another.

After choosing the natural or manmade fibrous material, which is preferably muslin cloth, the user may apply a stiffening agent to the fibrous material 15. In one embodiment, the user may apply both a stiffening agent and a backing to the fibrous material. The stiffening agent is optional and provides an aged looked on the back of the fibrous material. An example of a stiffening agent is wallpaper adhesive applied to the muslin cloth on the surface not having the printed image. The stiffening agent or backing provides the stability that may be necessary in certain printing conditions to prevent jamming of the printer when delivering the fibrous material through the printer. Alternatively, instead of using a stabilizing material therewith, the user may simply use the natural or manmade fibrous material without any stiffening agent or backing, which offers advantages in accordance with the present invention, so long as the fibrous material does not create a jamming problem inside the printer.

The stiffening agent applied is typically an organic compound that is coated onto the fibrous material. The stiffening agent can be a starch, paste, plaster, wallpaper or wallcovering adhesive, or other type of suitable material. The stiffening agent can offer advantages such as enhancing the appearance of the color of the printed indicia after printing is completed.

A printed indicia or image is applied to the fibrous material with an image-forming component 17. The printed indicia is an artistic application that can be applied to the cloth by printing, painting, drawing, or other suitable application using any artistic media. The printed indicia can be applied with, and the image-forming component can include pastel inks, printer inks, ink jet printer inks, water-based inks, water-color inks, food-color inks, or other suitable inks or paints. The printed indicia can be applied with a printer, or by free-form painting, or water-coloring on the fibrous material, or it can be applied with a weighted paint brush. The printed indicia can be applied with solventless or solvent-based inks, but the present invention offers particular advantages pertaining to the utility and benefits of using solventless inks. For simplicity, in discussing treatments of the image on the fibrous material in the remainder of the detailed description, the term "ink" should be understood to include the other image-forming components as well.

A series of chemicals or solutions are then applied to the fibrous material and the printed indicia thereupon. A cleanable metal tray surface is laid beneath the fibrous material to catch any residual chemical or solution that may drip or fall beneath the surface of the fibrous material.

In one embodiment a Type A or first chemical solution is applied on the front of the fibrous material where the printed indicia is printed thereon 21. The Type A solution can have many different embodiments. One embodiment of the Type A solution includes essential components including: glue, alcohol, oil, pectin, casein and yeast. The glue component can be in the form of polyvinyl acetate, milk-based glue (e.g., Elmer's glue), or an otherwise suitable glue. The alcohol component can be in the form of rubbing alcohol, drinking alcohol, or an otherwise suitable alcohol. The oil component can be canola oil, vegetable oil, coconut oil, or an otherwise suitable oil. The yeast helps to break down the casein. The user should wait at least 12 hours to 2 weeks so that the Type A chemical or solution is fully fermented when utilizing it on the printed indicia 19.

The casein component is a very important component of the Type A chemical or solution of the present invention. The casein component is a milk byproduct. Casein is the chief protein in milk, and it is also the main ingredient in cheese. The casein can be made from the curd component of the milk after the curd separates from the whey component of the milk. Casein separates as curd when milk sours, or when acid is added. It also separates from sweet milk when the enzyme rennin is added. Casein contains carbon, hydrogen, nitrogen, oxygen, phosphorus, and sulfur. Pure casein is a tasteless, odorless, white solid. Cow milk contains about 3 percent casein. The curd is washed, dried, and ground for curing in solution to be used on fabric. Casein is also used to waterproof the fabric with a starch or casein clay base putty. A non-casein clay base will break down at a faster exchange.

The principal casein fractions are alpha(s1) and alpha(s2)-caseins, β-casein, and kappa-casein. The common compositional factor is that caseins are conjugated proteins, most with phosphate groups esterified to serine residues. These phosphate groups are important to the structure of the casein micelle. This is needed in the solution making. Calcium binding by the individual caseins is proportional to the phosphate content.

The high number of proline residues in casein causes particular bending of the protein chain and inhibits the formation of close-packed, ordered secondary structures. Casein contains no disulfide bonds. As well, the lack of tertiary structure accounts for the stability of casein's against heat denaturation because there is very little structure to unfold. Without a tertiary structure there is considerable exposure of hydrophobic residues. This results in strong association reactions of the caseins and renders them insoluble in water. Alcohol is the best choice but must be controlled with other parts.

Within the group of caseins, there are several distinguishing features based on their charge distribution and sensitivity to calcium precipitation. Two embodiments of casein follow:

Beta-casein: (molecular weight 24,000; 209 residues, 35 prolines) Beta-casein has a highly charged N-terminal region and a hydrophobic C-terminal region. It is a very amphiphilic protein and acts like a detergent molecule. It is temperature dependent and will form a large polymer at 20° C. but not at 4° C. It is less sensitive to calcium precipitation.

Kappa-casein: (molecular weight 19,000; 169 residues, 20 prolines) Kappa-casein is very resistant to calcium precipitation, thereby stabilizing other caseins. Rennet cleavage at the Phe105-Met106 bond eliminates the stabilizing ability, leaving a hydrophobic portion called para-kappa-casein, and a hydrophilic portion called kappa-casein glycomacropeptide (GMP), or more accurately, caseinomacropeptide (CMP).

Most, but not all, of the casein proteins exist in a colloidal particle known as the casein micelle. Its biological function is to carry large amounts of highly insoluble CaP to mammalian young in liquid form and to form a clot in the stomach for more efficient nutrition. Besides casein protein, calcium and phosphate, the micelle also contains citrate, minor ions, lipase and plasmin enzymes, and entrapped milk serum. These micelles are rather porous structures, occupying about 4 ml/g and 6-12% of the total volume fraction of milk.

In the submicelle model, there are small aggregates of whole casein, containing 10 to 100 casein molecules, called submicelles. There are two different kinds of submicelle; with and without kappa-casein. These submicelles contain a hydrophobic core and are covered by a hydrophilic coat which is at least partly comprised of the polar moieties of kappa-casein. The hydrophilic CMP of the kappa-casein exists as a flexible hair. The open model also suggests there are more dense and less dense regions within the midelle, but there is less of a well-defined structure. In this model, calcium phosphate nanoclusters bind caseins and provide for the differences in density within the casein micelle.

Colloidal calcium phosphate (CCP) acts as a cement between the hundreds or even thousands of submicelles that form the casein micelle. Binding may be covalent or electrostatic. Submicelles rich in kappa-casein occupy a surface position, whereas those with less are buried in the interior. The resulting layer, at least 7 mm thick, acts to prohibit further aggregation of submicelles by steric repulsion. The casein micelles are not static; there are three dynamic equilibria between the micelle and its surroundings: 1) The free casein molecules and submicelles, 2) The free submicelles and micelles, and 3) The dissolved colloidal calcium and phosphate.

More than 90% of the calcium content of skim milk is associated in some way or another with the casein micelle. The removal of Ca++ leads to reversible dissociation of β-casein or Beta-caesin without micellular disintegration. The addition of Ca+++ leads to aggregation. Furthermore, casein is among the most hydrophobic proteins and they play a role in the stability of the micelle. Hydrophobic interactions are very temperature sensitive, which is important in fusing solution to cloth, and control all factors of the yeast, alcohol, and vinegar binding to the carrier of cellulose without damaging printed ink.

One example of the Type A chemical or solution and its component parts is as follows (percentages are by volume for a four gallon batch):

EXAMPLE 1 about 5% oil about 65-78% adhesive/glue about 5% cologne optional about 5% alcohol about 5% imitation vanilla or propylene glycol about 10% vinegar (preferably white vinegar)

about ½-¼% salt (preferably about ½ teaspoon)

about 3% pectin (fruit preservative)

about 2%-6% casein (preferably about ½ pint)

resin optional

Another example of the Type A chemical or solution and its component parts is as follows (percentages are by volume for a four gallon batch):

EXAMPLE 2 about 5-10% oil about 65-78% adhesive/glue about 5% cologne optional about 5% alcohol about 5% imitation vanilla or propylene glycol about 5-10% vinegar (preferably white vinegar)

about ½%-¼% salt (preferably about ½ teaspoon)

about 3-5% pectin (fruit preservative)

about 2%-10% casein (preferably about ½ pint)

about ½%-3% yeast resin optional

In each of these examples the component parts can be mixed together for a period of time in the range of about 12 hours to over several years. Generally, the longer the mixture of components is mixed together, the better chemical or solution results for the Type A chemical or solution. There is a 20% variance to age for the effect on the natural fiber cloth.

The Type A chemical or solution is applied to lift the pigment of the ink or dye from the fabric to the Type A chemical or solution. The Type A chemical helps to intensify the colors of the ink. The purpose of applying the Type A chemical or solution is to control the dying of the ink into the fabric. As time goes on the alcohol component of the Type A chemical or solution dissolves the ink and lessens the amount and quality of the pixilation, thereby creating the appearance that the ink appears as an antique painting as opposed to a machine printed product printed by a computer or ink-jet printer 23. The pigment of the ink or dye is lifted to create the appearance that the printed indicia is an authentic antique painted image that was constructed by hand or brush rather than printer generated 23.

After applying the Type A chemical or solution, the user typically waits a period of time while it is wet before applying a Type B or second chemical or solution 25. In the preferred embodiment, the user waits a period of about one minute before applying the Type B chemical or solution. In any event, the Type B chemical or solution is best applied when the A chemical or solution is still wet to at least some degree.

After applying the Type A chemical or solution, the Type B chemical or solution is applied to the fibrous material on top of the printed indicia and the Type A chemical or solution. The purpose of applying the Type B chemical or solution is to stop the dying process initiated by applying the Type A solution 27. The effect of applying the Type B chemical or solution is to permanently set the ink in place 27. The Type B solution can have many embodiments. Type B solutions include an acrylic polymer such as polyurethane, beeswax, clear wax, floor wax, or a polymer emulsion to give a crunchy look. Heat is not necessary, but will speed up the effects of the Type B chemical. The Type B chemical can be applied, for example, with a roller. One embodiment of the Type B solution includes two components including an optional stain and an acrylic polymer. The stain can be a varnish stain, a faux glazing, an oil paint, a dye, or an otherwise suitable stain. The acrylic polymer can be a polymer emulsion, a clear wax, a floor wax, or an otherwise suitable acrylic polymer. The acrylic polymer can be of a clear or an amber color.

As understood by those skilled in the art, acrylic polymers, used as coating binders, are comprised mainly of esters that are polymerized by processes of polymerization usually utilizing a free radical mechanism. Acrylic acid and methacrylic acid can be used as acrylic polymers. Acrylic and methacrylic acids consist of varying proportions of acrylic monomers. By altering the ratios of the monomers, the polymer's balance of properties are able to be changed. The monomer composition can have a strong influence on the properties of the resulting composition of the film properties of the cloth veneer. The monomer composition controls the durability, water resistance, and gloss potential of the latex polymer. Typical latex monomers, for example, can include ethyl acrylate, methyl methacrylate, and methacrylic acid.

The Type B solution sets the ink and stops the alcohol from breaking down the pixilation of the ink, so that the pigment of the ink retains its loading capacity and remains useful in the dying process. The Type B solution helps to permanently set the ink, thereby retaining the image before pixilation of the ink is dissolved to a damaging extent by the Type A chemical or solution 27. When the Type B chemical or solution is applied to the Type A chemical or solution, it binds the acrylic to the casein. After such application, when wet the combination appears white and milky, and when dry the combination appears clear, translucent or transparent, and glossy. The end product from the printed indicia and Type A and Type B products is a solventless ink product that can be advantageously utilized and manufactured in the arts.

Optionally, embodiments of the invention can include a drying or heating process 29 and a washing process 31, and can also include a cycle of alternating heating and washing processes. Alternatively, the invention can include no heating or washing process after application of the Type A and Type B chemicals or solutions.

With respect to the heating process 29, after the Type A and Type B chemicals or solutions are applied, the fibrous material is heated to a temperature greater than 250 degrees Fahrenheit, and preferably between 265 and 285 degrees Fahrenheit, and even more preferably at about 275 degrees Fahrenheit. The heat is typically applied to the fibrous material for at least 1 minute, and preferably for at least 10 minutes. The heat performs the function of drying any portions that remain wet after application of the Type A and Type B chemicals.

After the heating process is finished, the fibrous material can be washed through a washing process 31. A Type C or third chemical or solution is utilized to wash the material. The Type C chemical or solution generally includes a water solution, or a soap solution to saponificate on the fibrous material to clean the material for final use.

In one embodiment, the heating and washing cycles can be repeated in a cycle of heating then washing. Alternatively, in accordance with the invention, after applying the Type A and Type B chemicals or solutions, it is not necessary to heat or wash the fibrous material and printed indicia at all. After applying the Type A and Type B solutions, even without any heating or washing processes, the printed indicia will have a painted antique appearance. In some cases, though, the printed indicia on the fibrous material may appear more aged and antique from application of the heating and washing processes. In another embodiment, the fibrous material can be pressed or ironed at the end of the process to create a neat appearance without wrinkles or lines thereupon 33.

After the Type A and Type B solutions are fully dried, the cloth is ready for utilitarian application. For example, the cloth can be molded 39 as veneer to a desired surface 37. The user can use a fusing method, glue, adhesive, or an otherwise suitable molding method to mold the fibrous material to the applicable surface. After molding the material to the surface, the user can apply a varnish, paint, resin, silicone, or other substance to the print for enhanced appearance on the surface 41. The cloth is typically surface treatable for further adaptations and modifications thereon. The fibrous cloth material can be applied to any type of surface, including for example, pictures, furniture, walls, ceilings, murals, wood, sheet rock, metal, glass, laminates, clothing, smooth surfaces, rough surfaces, or other suitable surfaces.

The method of the present invention has important advantages and benefits. As a result of combining the Type A chemical or solution with the Type B chemical or solution, the fibrous cloth material can include properties that provide an antique or aged appearance to the cloth, and can also provide properties to affect carbon dating as well. The method can also be used for restoring old paper, as well. The beneficial weathering resistance of acrylic polymers is primarily due to their resistance to hydrolysis and their lack of absorption of ultraviolet light which is most responsible for degradation. The ultraviolet light aids in enhancement of the affects on the cloth when drying the cloth for weathering resistance. The weathering resistance enhances the preservation of the ink from the format printing process for long-term use as a cloth veneer for applications on various surfaces. As a result, after the process the cloth is ready for applications on the surface, another image created with another image-forming component 35, which can include pigments, stains, varnish, resins, paints or other choice additives. One such additive is from an ink base that is not solvent-based and that is environmentally friendly.

Furthermore, solvent-based inks require the most expensive machinery in the field, which can operate as a trade barrier in many instances. Solventless inks need not utilize such expensive machinery. Therefore, a further advantage or benefit of the present invention is that the printed indicia can be applied to the fibrous material using solventless inks and inexpensive machinery such as simple ink-jet printers rather than the costly and expensive machinery that is required when utilizing solvent-based inks. The Type A chemical or solution, when combined with the Type B chemical or solution, as applied to the printed indicia of a fibrous cloth material, advantageously make a computerized printed image appear as an authentic painting that can also appear aged or antique without utilizing the expensive machinery otherwise required from solvent-based ink products.

While the invention has been shown in only some of its forms, it should be apparent to those skilled in the art that it is not so limited, but is susceptible to various changes without departing from the scope of the invention.

The invention claimed is:

1. A method of creating an image with an antique appearance, comprising:

(a) providing an image formed with an image-forming component on a fibrous material;

(b) antiquing the image by dissolving the image-forming component with a first chemical solution; and (c) setting the image-forming component with a second chemical solution that stops the antiquing of the image with the first chemical solution.

2. The method of claim 1, wherein:

the first chemical solution comprises: a glue component, an alcohol component, an oil component, a pectin component, a casein component, and yeast; and the second chemical solution comprises an acrylic polymer selected from the group consisting of polyurethane, clear wax, floor wax, bees wax, and a polymer elusion.

3. The method of claim 1, further comprising the steps of:

(d) drying portions of the image after application of the first and second chemical solutions; and (e) heating the image and fibrous material in order to dry portions of the image after application of the first and second chemical solutions.

4. The method of claim 1, further comprising the steps of:

(d) washing the image and fibrous material with a third chemical solution; and (e) pressing the fibrous material with the image so that the image is free of wrinkles and fold lines.

5. The method of claim 1, further comprising the step of (d) washing the image and fibrous material with a third chemical solution that comprises water and soap.

6. The method of claim 1, further comprising the steps:

(d) heating the image and fibrous material in order to dry portions of the image after application of the first and second chemical solutions;

(e) washing the image and fibrous material with a third chemical solution that comprises water and soap;

(f) pressing the fibrous material with the image so that the image is free of wrinkles and fold lines; and then (g) creating an additional image on the fibrous material with a second image-forming component.

7. The method of claim 1, wherein the ink of the image-forming component comprises food coloring.

8. The method of claim 1, wherein the ink of the image-forming component comprises ink.

9. The method of claim 1, wherein the ink of the image-forming component comprises a solventless ink.

10. A method of creating an image with an antique appearance, comprising:

(a) providing a fibrous material and a first chemical solution comprising yeast;

(b) placing an ink-based image on a surface of the fibrous material;

(c) fermenting the first chemical solution;

(d) applying the fermented first chemical solution to the image and fibrous material to antique the image by dissolving the ink; and (e) setting the ink with a second chemical solution that stops the dissolving of the ink with the fermented first chemical solution.

11. The method of claim 10, wherein the first chemical solution comprises: a glue component, an alcohol component, an oil component, a pectin component, a casein component, and yeast.

12. The method of claim 10, wherein the second chemical solution comprises an acrylic polymer selected from the group consisting of polyurethane, clear wax, floor wax, bees wax, and a polymer elusion.

13. The method of claim 10, wherein the second chemical solution comprises an acrylic polymer and a stain, wherein:

the acrylic polymer is selected from the group consisting of polyurethane, clear wax, floor wax, bees wax, and a polymer elusion; and the stain is selected from the group consisting of a varnish stain, a faux glazing, an oil paint, and a dye.

14. The method of claim 10, wherein the first chemical solution comprises by volume:

about 5-12% of an oil component;

about 75-80% of a glue component;

about 4-11% of an alcohol component such that the percentage of the alcohol component is about 1% less then the percentage of the oil component;

about 2-6% of a casein component; and the remaining percent comprising a yeast component, a cologne component, a vanilla component, a vinegar component, a pectin component, and a salt component.

15. The method of claim 10, wherein the first chemical solution comprises:

about 5-10% of an oil component;

about 65-78% of a glue component;

about 5% of an alcohol component;

about 2-10% of a casein component;

about ½-3% of a yeast component;

about 5% of a cologne component;

about 5% of an imitation vanilla or propylene glycol component;

about 5-10% of a white vinegar component;

about 3-5% of a pectin component; and about ¼-½% of a salt component.

16. The method of claim 10, further comprising the steps:

(f) heating the image and fibrous material at a temperature greater than 250 degrees Fahrenheit in order to dry portions of the image after application of the fermented first chemical solution and the second chemical solution;

(g) applying a third chemical solution to the image and fibrous material in order to wash the image and fibrous material; and (h) pressing the fibrous material with the image so that the image is free of wrinkles and fold lines.

17. The method of claim 16, wherein in step (f) the image and fibrous material are heated at a temperature between about 265 and 285 degrees Fahrenheit for at least one minute.

18. The method of claim 16, wherein in step (f) the image and fibrous material are heated at a temperature about 275 degrees Fahrenheit for at least ten minutes.

19. A method of creating an image having an antique appearance on a surface of base structure, the method comprising:

(a) providing an image formed with an image-forming component on a fibrous material, and base structure having a base surface;

(b) antiquing the image by dissolving the image-forming component with a first chemical solution;

(c) setting the image-forming component with a second chemical solution that stops the antiquing of the image with the first chemical solution; and (d) molding the fibrous material to the base surface.

20. The method of claim 19, further comprising the step of coating the image with an outer coating selected from the group consisting of varnish, paint, resin, and silicone.

* * * * *